US009293819B2

(12) United States Patent
Lee et al.

(10) Patent No.: US 9,293,819 B2
(45) Date of Patent: Mar. 22, 2016

(54) ANTENNA APPARATUS AND MOBILE TERMINAL HAVING THE SAME

(71) Applicant: LG ELECTRONICS INC., Seoul (KR)

(72) Inventors: Jaegon Lee, Seoul (KR); Chisang You, Seoul (KR); Changil Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 333 days.

(21) Appl. No.: 13/889,836

(22) Filed: May 8, 2013

(65) Prior Publication Data

US 2013/0300626 A1 Nov. 14, 2013

(30) Foreign Application Priority Data

May 9, 2012 (KR) ..... 10-2012-0049340

(51) Int. Cl.

| | |
|---|---|
| ***H01Q 1/38*** | (2006.01) |
| ***H01Q 1/50*** | (2006.01) |
| ***H01Q 1/24*** | (2006.01) |
| ***H01Q 9/42*** | (2006.01) |
| ***H01Q 5/378*** | (2015.01) |

(52) U.S. Cl.

CPC ..... *H01Q 1/50* (2013.01); *H01Q 1/243* (2013.01); *H01Q 5/378* (2015.01); *H01Q 9/42* (2013.01)

(58) Field of Classification Search

USPC ..... 343/700 MS, 702

See application file for complete search history.

(56) References Cited

U.S. PATENT DOCUMENTS

| | | | | |
|---|---|---|---|---|
| 7,136,020 | B2 * | 11/2006 | Yamaki | 343/702 |
| 8,988,292 | B2 * | 3/2015 | Hotta et al. | 343/702 |
| 2004/0113845 | A1 * | 6/2004 | Mikkola et al. | 343/700 MS |
| 2007/0229358 | A1 * | 10/2007 | Chi et al. | 343/700 MS |
| 2014/0361948 | A1 * | 12/2014 | TANAKA et al. | 343/861 |

* cited by examiner

*Primary Examiner* — Tan Ho

(74) *Attorney, Agent, or Firm* — Birch, Stewart, Kolasch & Birch, LLP

(57) ABSTRACT

An antenna apparatus includes: a first member ground-connected to a ground of a printed circuit board (PCB); a second member spaced from the first member in parallel, and configured to capacitive coupling-feed the first member so as to transmit and receive signals of a first frequency band; and a third member extending from the second member by a prescribed length, so as to have a bandwidth extending up to a second frequency band adjacent to the first frequency band.

20 Claims, 12 Drawing Sheets

ANTENNA APPARATUS AND MOBILE TERMINAL HAVING THE SAME

CROSS-REFERENCE TO RELATED APPLICATION

Pursuant to 35 U.S.C. §119(a), this application claims the benefit of earlier filing date and right of priority to Korean Application No. 10-2012-0049340, filed on May 9, 2012, the contents of which is incorporated by reference herein in its entirety.

BACKGROUND OF THE INVENTION

1. Field of the Invention

The present disclosure relates to a mobile terminal, and particularly, to a mobile terminal having an antenna apparatus for transmitting and receiving radio signals.

2. Background of the Invention

As a mobile terminal becomes multifunctional, the mobile terminal can be allowed to capture still images or moving images, play music or video files, play games, receive broadcast, etc., so as to be implemented as an integrated multimedia player.

Terminals can be divided into mobile/portable terminals and stationary terminals according to their mobility. The mobile terminal is a portable device that can be carried anywhere and have one or more of a function of performing voice and video calls, a function of inputting/outputting information, a function of storing data, etc.

In order to support and enhance such functions of the terminal, it can be considered to improve configuration and/or software of the terminal.

Generally, an antenna has a narrow bandwidth characteristic, and has a lowered efficiency when miniaturized. That is, if an antenna is miniaturized, a radiation pattern of the antenna has an omni-directional characteristic and an antenna gain is lowered. Further, an input resistance of the antenna is greatly reduced, and a reactance is greatly increased, resulting in a very narrow bandwidth of the antenna.

Due to a small physical space of the small antenna, the small antenna has a lowered antenna efficiency. For an enhanced antenna efficiency, a bandwidth of the small antenna is limited. Here, the antenna efficiency indicates a ratio between power radiated from the antenna and power supplied to the antenna.

An antenna apparatus having a small size and a wide bandwidth may be considered.

Further, may be also considered an antenna apparatus capable of minimizing interference between the mobile terminal and an external device, and of reducing a user's health from deteriorating due to electromagnetic waves generated from the mobile terminal for wireless communication.

SUMMARY OF THE INVENTION

Therefore, an aspect of the detailed description is to provide a mobile terminal having an antenna apparatus of an enhanced performance.

Another aspect of the detailed description is to provide an antenna apparatus capable of transmitting and receiving multi radio signals of a high frequency band and a low frequency band in a small space, and a mobile terminal having the same.

To achieve these and other advantages and in accordance with the purpose of this specification, as embodied and broadly described herein, there is provided an antenna apparatus, comprising: a first member ground-connected to a ground of a printed circuit board (PCB); a second member spaced from the first member in parallel, and configured to capacitive coupling-feed the first member so as to transmit and receive signals of a first frequency band; and a third member extending from the second member by a prescribed length, so as to have a to bandwidth extending up to a second frequency band adjacent to the first frequency band.

According to an embodiment of the present invention, the first member and the third member may be spaced from each other by a distance more than $0.2\lambda_1$ times of a wavelength ($\lambda_1$) corresponding to a first resonance frequency, for prevention of electrical connection therebetween.

According to an embodiment of the present invention, the first member may be connected to a ground of a PCB adjacent thereto, and the second member may be feed-connected to the PCB.

According to an embodiment of the present invention, the first frequency band may be a frequency band corresponding to GSM-850 or GSM-900 communication service, and the second frequency band may be a frequency band corresponding to B13 or B17 communication service of long term evolution (LTE).

According to an embodiment of the present invention, a path implemented from a feed connection portion (F) of the PCB via the second member and the first member, may form a resonance length corresponding to $\lambda_1/8$ of a wavelength ($\lambda_1$) corresponding to the first frequency.

According to an embodiment of the present invention, a path implemented from the feed connection portion (F) of the PCB via the second member and the third member, may form a resonance length corresponding to $\lambda_2/4$ of a wavelength ($\lambda_2$) corresponding to the second frequency.

According to an embodiment of the present invention, the length of the second member extending from the first member in parallel, may be formed to be more than ½ of the length of the first member.

According to another aspect of the present invention, there is provided an antenna apparatus, comprising: a first member ground-connected to a ground of a printed circuit board (PCB); a second member having at least part thereof spaced from the first member in parallel, and configured to capacitive coupling-feed the first member so as to transmit and receive signals of a first frequency band; and a third member extending from the second member, so as to have a bandwidth is extending up to a second frequency band adjacent to the first frequency band, and spaced from the first member in parallel.

According to an embodiment of the present invention, the interval between the first member and the second member may be within the range of $0.1\lambda_1$~$0.2\lambda_1$ of a wavelength ($\lambda_1$) corresponding to a first resonance frequency, and the interval between the second member and the third member may be within the range of $0.1\lambda_1$~$0.2\lambda_1$ of a wavelength ($\lambda_2$) corresponding to a second resonance frequency.

According to an embodiment of the present invention, the members may be formed on a carrier, and the first and third members may be disposed on different positions of the carrier for prevention of electrical connection therebetween.

To achieve these and other advantages and in accordance with the purpose of this specification, as embodied and broadly described herein, there is also provided a mobile terminal, comprising: a terminal body having a speaker disposed on an upper part thereof; a PCB mounted in the terminal body and having a ground; and an antenna apparatus mounted below the terminal body, and configured to transmit and receive signals of a first frequency band or a second frequency band adjacent to the first frequency band, by being feed-connected and ground-connected to the PCB, wherein the antenna apparatus comprises: a first member ground-connected to the PCB; a second member spaced from the first member in parallel, and configured to capacitive coupling-feed the first member so as to transmit and receive signals of the first frequency band; and a third member extending from the second member by a prescribed length, so as to have a bandwidth extending up to the second frequency band.

According to an embodiment of the present invention, the members may be formed on the PCB having a plurality of layers, the first and second members may be formed on a first layer of the PCB, and the third member may be formed on a second layer spaced from the first layer for prevention of electrical connection with the first member.

According to an embodiment of the present invention, the members may be formed on a carrier adjacent to the PCB, and the first and third members may be disposed on different positions of the carrier for prevention of electrical connection therebetween.

According to another aspect of the present invention, there is provided a mobile terminal, comprising: a terminal body having a speaker disposed on an upper part thereof; a PCB mounted in the terminal body and having a ground; and an antenna apparatus mounted below the terminal body, and configured to transmit and receive signals of a first frequency band or a second frequency band adjacent to the first frequency band, by being feed-connected and ground-connected to the PCB, wherein the antenna apparatus comprises: a first member ground-connected to the PCB; a second member having at least part spaced from the first member in parallel, and configured to capacitive coupling-feed the first member so as to transmit and receive signals of the first frequency band; and a third member extending from the second member, so as to have a bandwidth extending up to the second frequency band adjacent to the first frequency band, and spaced from the first member in parallel.

The present invention may have the following advantages.

Firstly, as the small antenna is amounted to the mobile terminal according to at least one embodiment of the present invention, the mobile terminal can be easily designed and can be miniaturized.

Secondly, since coupling occurs as the conductive members are formed in parallel with each other, a resonance frequency can be lowered. This can allow a function to be implemented at a desired low frequency band, especially, an enhanced antenna performance to be implemented at an LTE band, with a shorter resonance length.

Thirdly, hearing aid compatibility (HAC) measured from a receiver can be enhanced by the antenna apparatus using a gap coupling feeding method.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Hereinafter, a mobile terminal of the present disclosure will be explained in more detail with reference to the attached drawings. The suffixes "module" and "unit or portion" for components used in the following description merely provided only for facilitation of preparing this specification, and thus they are not granted a specific meaning or function. For the sake of brief description with reference to the drawings, the same or equivalent components will be provided with the same reference numbers, and description thereof will not be repeated. Singular expressions include plural expressions which do not have any obviously different meaning in view of a context.

The mobile terminal according to the present disclosure may include a portable phone, a smart phone, a laptop computer, a digital broadcasting terminal, Personal Digital Assistants (PDA), Portable Multimedia Player (PMP), a navigation system, etc. However, it will be obvious to those skilled in the art that the present invention may be also applicable to a fixed terminal such as a digital TV and a desktop computer.

Figure 1:
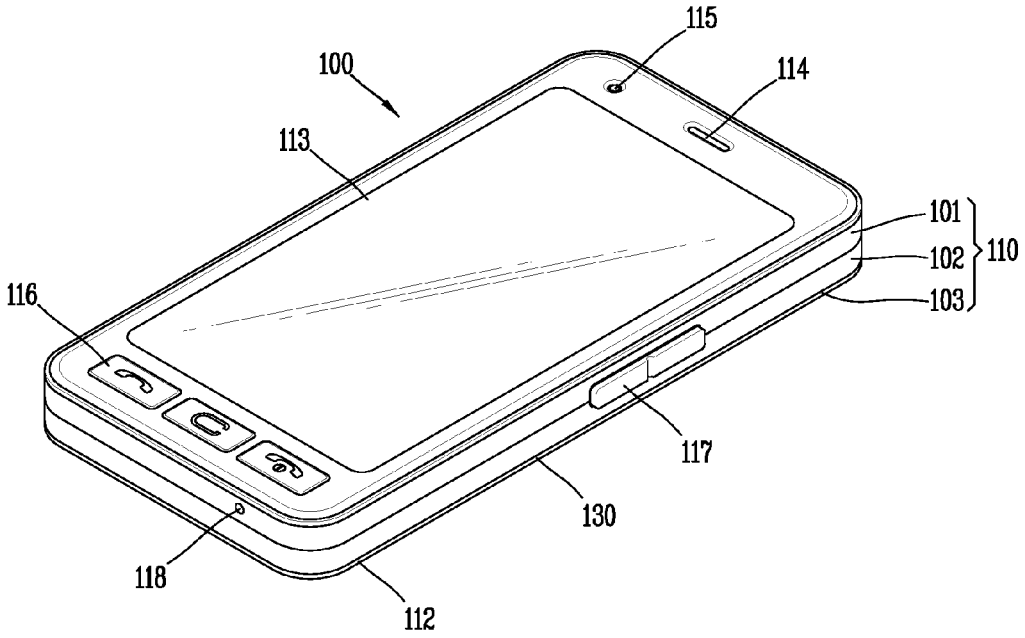
FIG. 1 is a front perspective view of a mobile terminal according to an embodiment of the present invention.

FIG. 1 is a front perspective view of a mobile terminal 100 according to an embodiment of the present invention.

The mobile terminal 100 includes a terminal body 110 which forms the appearance of the mobile terminal 100.

The terminal body 110 includes a case (casing, housing, cover, etc.) which forms the appearance of the terminal body 110. The case may include a front case 101, a rear case 102 covering an opposite surface to the front case 101, and a battery cover 103 configured to cover the rear surface of the terminal body 110. A space formed by the front case 101 and the rear case 102 may accommodate various components therein.

At least one intermediate case or frame may be additionally disposed between the front case 101 and the rear case 102.

Such cases may be formed by injection-molded synthetic resin, or may be to formed using a metallic material such as stainless steel (STS) or titanium (Ti).

On the front surface of the terminal body 110, may be disposed a display unit 113, a first audio output unit 114, a first image input unit 115, first and second user units 116 and 117, an audio input unit 118, an interface unit 119, etc.

The display unit 113 includes a liquid crystal display (LCD) module, is organic light emitting diodes (OLED), e-paper, etc., each for visually displaying information.

The display unit 113 may further include a touch screen onto which information is input in a user's touch manner. On the display unit 113, may be displayed visual information such as numbers, characters and symbols, for input of telephone numbers, etc. A user may input information by touching the visual information displayed on the display unit 113.

The first audio output unit 114 may be implemented as a receiver or a loud speaker. The first audio output unit 114 is disposed on one end of the terminal body 110 so as to be positioned on a user's ear.

The first image input unit 115 may be implemented as a camera module for capturing a user's still images or moving images.

The first and second user input units 116 and 117 are manipulated to receive a command for controlling the operation of the mobile terminal 100. The first and second user input units 116 and 117 may be referred to as manipulation portions, and may include any type of ones that can be manipulated in a user's tactile manner.

For instance, the first and second user input units 116 and 117 may be implemented as a dome switch or a touch pad for inputting commands or information in a user's push or touch manner. Alternatively, the first and second user input units 116 and 117 may be implemented, for example, as a wheel for rotating a key, a jog, or a joystick.

The first user input unit 116 is configured to input various commands such as START, END and SCROLL, and the second user input unit 117 is configured to have a function to control the size of a sound output from the first audio output unit 114, a function to activate/deactivate a touch recognition mode of the display unit 113, etc.

The audio output unit 118 may be implemented as a microphone for receiving a user's voice, other sound, etc.

The interface unit 119 serves a path through which the mobile terminal 100 performs data exchange, etc. with an external device. For example, the interface unit 119 may be at least one of a connection terminal through which the mobile terminal 100 is connected to an ear phone by cable or radio, a port for local area communication, e.g., an infrared data association (IrDA) port, a Bluetooth portion, a wireless LAN port, and power supply terminals for supplying power to the mobile terminal 100.

The interface unit 119 may be a card socket for accommodating an external card such as a subscriber identification module (SIM) card, a user identity module (UIM) card or a memory card for storing information.

Figure 2:
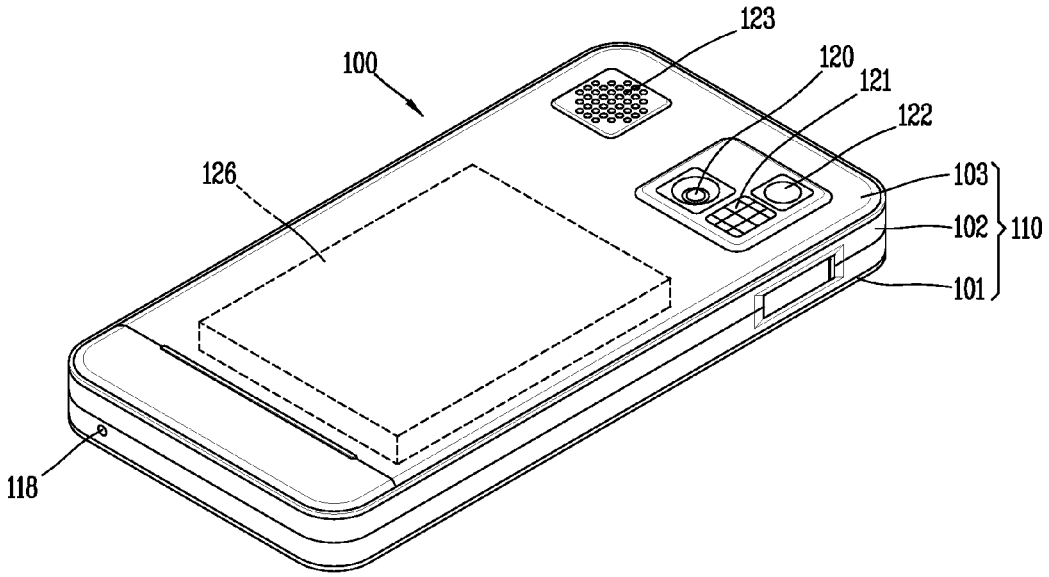
FIG. 2 is a rear perspective view of a mobile terminal according to an embodiment of the present invention.

FIG. 2 is a rear perspective view of the mobile terminal of FIG. 1.

Referring to FIG. 2, a second image input unit 120 may be additionally mounted to the rear surface of the terminal body 110. The second image input unit 120 may face a direction which is opposite to a direction faced by the first image input unit 115 (refer to FIG. 1), and may have different pixels from those of the first image input unit 115.

For example, the first image input unit 115 may operate with relatively lower pixels (lower resolution). Thus, the first image input unit 115 may be useful when a user can capture his face and send it to another party during a video call or the like. On the other hand, the second image input unit 120 may operate with a relatively higher pixels (higher resolution) such that it can be useful for a user to is obtain higher quality pictures for later use.

A flash 121 and a mirror 122 may be disposed close to the second image input unit 120. When capturing an object by using the second image input unit 120, the flash 121 provides light onto the object. When the user captures an image of himself/herself by using the second image input unit 120, the mirror can be used for the user to look at himself/herself therein.

A second audio output unit 123 may be additionally disposed on the rear surface of the terminal body 110. The second audio output unit 123 may implement a stereo function together with the first audio output unit 114 (refer to FIG. 1), and may be used for calling in a speaker phone mode.

A power supply unit 125 for supplying power to the mobile terminal 100 is mounted to the rear case 102. The power supply unit 125 may be implemented as a chargeable battery 125 like in the preferred embodiment. A battery cover 126 for covering the battery 125 is detachably mounted to the rear case 102.

A broadcast signal receiving antenna 124 as well as an antenna for calling may be additionally disposed on a side surface of the terminal body 110. The broadcast signal receiving antenna 124 may be configured to retract into the terminal body 110.

Figure 3:
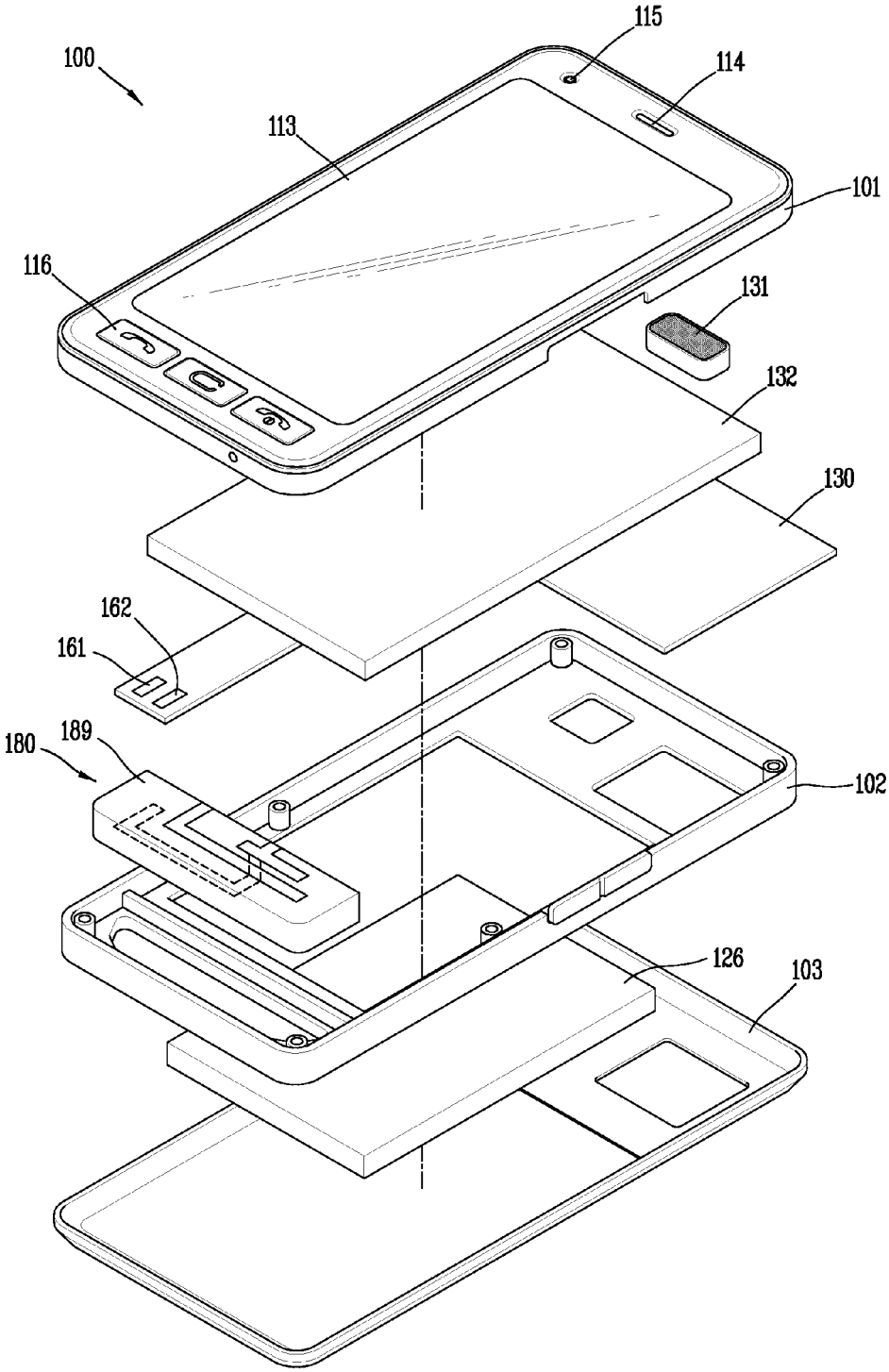
FIG. 3 is an exploded perspective view of the mobile terminal of FIG. 1.

FIG. 3 is an exploded perspective view of the mobile terminal 100 of FIG. 1.

A printed circuit board (PCB) 130 is mounted between the front case 101 and the rear case 102, and electronic components for operating various types of functions of the mobile terminal 100 are mounted on the circuit board 130.

A receiver 131 for implementing the audio output unit 114 is mounted to one end of the PCB 130, and a display module 132 for outputting visual information is mounted below the receiver 131. A switch for applying an input signal by a user's pressing operation may be mounted below the display module 132, which forms a first user input unit 116.

Circuit patterns formed of a conductive material and configured to connect electronic components mounted on the PCB 130 with each other, are provided on the surface or inside the PCB 130.

A built-in antenna 180 for transmitting and receiving radio signals is mounted at one side of the PCB 130, i.e., another end of the terminal body 110.

The built-in antenna 180 may include a radiator formed of a conductive material, a carrier 189 for mounting and supporting the radiator, etc.

The carrier 189 is mounted below the PCB 130, and the radiator may be attached to one surface of the carrier 189 in a patterned manner. A feeding terminal electrically connected to the PCB 130 may be formed at the end of the radiator.

A ground portion electrically connected to the built-in antenna 180 may be provided at the terminal body 110, and the ground portion may be formed by the PCB 130. The built-in antenna 180 is configured to convert received radio signals into a current to thus feed to the PCB 130. The current fed from the built-in antenna 180 flows onto the PCB 130. Transceiver circuits 161 and 162 are also shown.

Figure 4A:
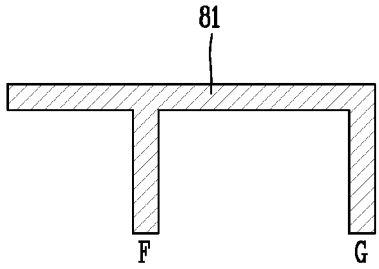
FIG. 4A is a conceptual view of an antenna apparatus according to a first comparative example of the present invention.
Figure 4B:
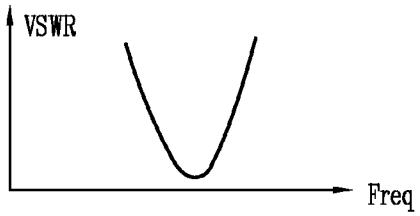
FIG. 4B is a graph showing a voltage standing wave ratio (VSWR) according to a frequency of the antenna apparatus of FIG. 4A.
Figure 5A:
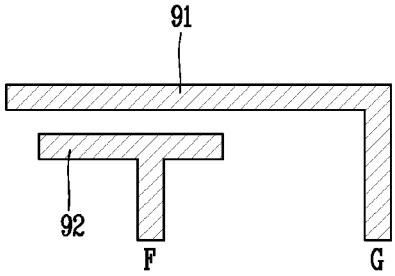
FIG. 5A is a conceptual view of an antenna apparatus according to a second comparative example of the present invention.
Figure 5B:
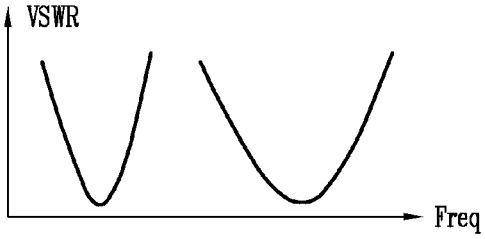
FIG. 5B is a graph showing a voltage standing wave ratio (VSWR) according to a frequency of the antenna apparatus of FIG. 5A.
Figure 6:
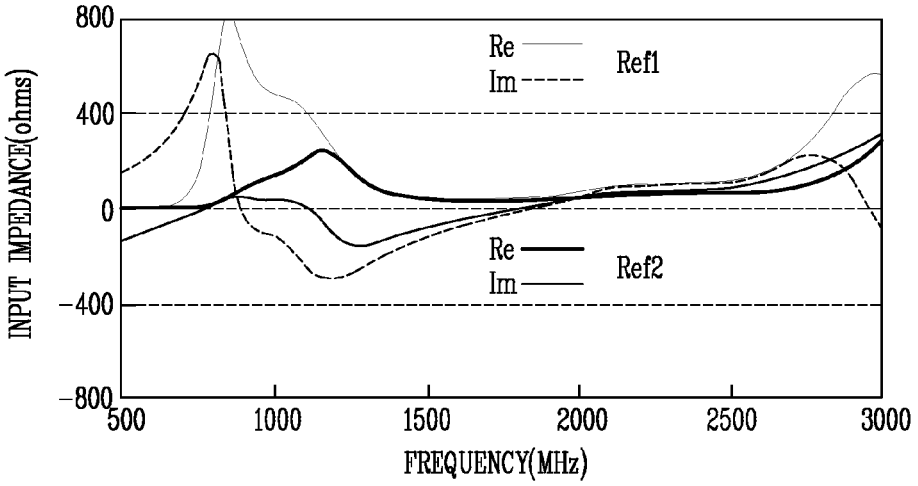
FIG. 6 is a graph showing input impedances according to frequencies of the antenna apparatuses according to first and second comparative examples.

FIG. 4A is a conceptual view of an antenna apparatus according to a first comparative example (Ref 1) of the present invention, and FIG. 4B is a graph showing a voltage standing wave ratio (VSWR) according to a frequency of the antenna apparatus of FIG. 4A. FIG. 5A is a conceptual view of an antenna apparatus according to a second comparative example (Ref 2) of the present invention, and FIG. 5B is a graph showing a voltage standing wave ratio (VSWR) according to a frequency of the antenna apparatus of FIG. 5A. FIG. 6 is a graph is showing input impedances according to frequencies of the antenna apparatuses according to the first and second comparative examples (Ref 1 and Ref 2).

As shown in FIG. 4A, the antenna apparatus according to a first comparative example (Ref 1) is a general PIFA type, which is ground-connected or feed-connected to parts extending from a conductive member 81. That is, a feed connection portion (F) for receiving signals from the PCB, and a ground connection portion (G) are formed at parts extending from the conductive member 81 in a bending manner.

As shown in FIG. 5A, the antenna apparatus according to the second comparative example (Ref 2) is an antenna apparatus for gap-coupling feeding a conductive member 91. One end of the first conductive member 91 is ground-connected to the PCB by the ground connection portion (G), and at least part of a second conductive member 92 is spaced from the first conductive member 91 in parallel. The second conductive member 92 is feed-connected to the PCB, and is configured to gap coupling-feed the first conductive member 91.

In the antenna apparatuses according to the first comparative example (Ref 1) and the second comparative example (Ref 2), the conductive member 81 and the first conductive member 91 were made to have the same length, and the results thereof were analyzed. It is assumed that a resonance frequency is ignored, the resonance frequency having a voltage standing wave ratio (VSWR) more than 3:1 where a sufficient radiation efficiency is not implemented. A resonance frequency of about 1.8 GHz was obtained from the first comparative example (Ref 1), and a resonance frequency of about 800 Hz was obtained from the second comparative example (Ref 2).

Generally, on a resonance circuit, an inductive reactance by an inductor is increases with a frequency, and a capacitive reactance by a capacitor decreases with a frequency. This will be explained with regard to a resonance of an antenna. If an inductive reactance is increased, a resonance frequency increases since an input impedance by an inductor is proportional to a frequency. If a capacitive reactance is increased, a resonance frequency decreases since an input impedance by a capacitor is inversely proportional to a frequency.

In the antenna apparatus according to the first comparative example (Ref 1), because the interval between the feed connection portion (F) and the ground connection portion (G) is large, the conductive members operate as a single inductor. As a result, an input impedance is great, i.e., a resonance frequency increases. As shown in FIG. 6, a resonance frequency where a real part and an imaginary part of an input impedance become equal, is about 1.8 GHz.

In the antenna apparatus according to the second comparative example (Ref 2), the first conductive member 91 and the second conductive member 92 formed in parallel with each other operate as a type of capacitor, due to the second conductive member 92 which gap coupling-feeds the first conductive member 91. Accordingly, an input impedance by a capacitor decreases, and thus a resonance frequency decreases. In this case, as shown in FIG. 6, a resonance frequency where a real part and an imaginary part of an input impedance become equal, is about 800 MHz.

As a gradient of an imaginary part changes due to capacitance values occurring by gap coupling feed, a region where a real part and an imaginary part become equal is increased. As a result, a dual resonance characteristic and a broad resonance characteristic are implemented.

Such antenna apparatus according to the second comparative example (Ref 2) has an intermediate characteristic between a PIFA type antenna apparatus and a monopole type antenna apparatus.

The mobile terminal may perform communication with radio base stations using radio communication. For instance, a cellular telephone may perform communication using cellular telephone bands of 850 MHz, 900 MHz, 1800 MHz and 1900 MHz (e.g., main global system for mobile communications or GSM cellular telephone bands). Communication should be performed even in a band of 1.92~2.17 GHz for a wideband code division multiple access (WCDMA) service. Further, communication should be performed even in a band of 704~960 MHz for B13 or B17 communication service of LTE (Long Term Evolution).

Referring to FIG. 4B, the antenna according to a first comparative example (Ref 1) has a single resonance characteristic. Referring to FIG. 5B, the antenna according to a second comparative example (Ref 2) has a multi resonance characteristic. That is, the antenna according to the second comparative example (Ref 2) has a resonance frequency of about 900 MHz and about 1700 MHz.

For communication even in a band of 704~960 MHz corresponding to an LTE service using the antenna according to the second comparative example (Ref 2), a bandwidth more than 250 MHz should be required.

The present invention may provide antenna apparatuses 180, 280 having multi resonance characteristics, each antenna apparatus having a bandwidth to more than 250 MHz and having a radiation efficiency where a VSWR is less than 3:1. Hereinafter, such antenna apparatuses will be explained in more detail with reference to the attached drawings.

Figure 7:
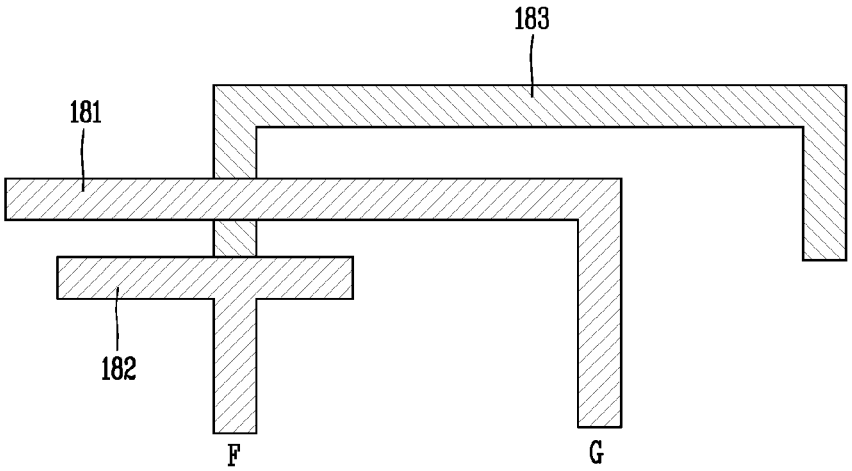
FIG. 7 is a conceptual view of an antenna apparatus according to a first embodiment of the present invention.

FIG. 7 is a conceptual view of an antenna apparatus 180 according to a first embodiment of the present invention.

The antenna apparatus 180 according to the first embodiment includes a first member 181 ground-connected to a ground of a printed circuit board (PCB), and a second member 182 disposed in parallel to the first member 181.

The second member 182 is ground-connected to the ground of the PCB, and is spaced from the first member 181 by a prescribed interval. The second member 182 capacitively coupling-feeds the first member 181 so that the antenna apparatus 180 can have a first resonance frequency. Preferably, the interval between the first member 181 and the second member 182 is within the range of $0.1\lambda_1$~$0.2\lambda_1$ of $\lambda_1$ corresponding to the first resonance frequency. Such interval is a factor which can be tuned for controlling an antenna characteristic. As the interval is controlled, a capacitance value is changed to increase or decrease a resonance frequency.

The antenna apparatus 180 according to the first embodiment is configured to resonate at a lower band, by using conductive members having a shorter length than those which do not adopt a capacitive coupling feeding method.

Preferably, the length of the second member 182 is formed to be longer than ½ of the length of the first member 181, so that the antenna apparatus 180 can be much influenced by a capacitor implemented by the first member 181 and the second member 182 through coupling feed, than by an inductor implemented by the first member 181.

As aforementioned, the second member 182 is formed so that the antenna apparatus 180 can have a first resonance frequency, by capacitively coupling-feeding the first member 181. In order to increase a bandwidth up to a second resonance frequency adjacent to the first resonance frequency, the antenna apparatus is provided with a third member 183 extending from the second is member 182. The third member 183 is extending from the second member 182 by a prescribed length, so that a path implemented from the feed connection portion (F) via the second member 182 and the third member 183 may correspond to a physical length of a second resonance frequency. That is, the length of the third member 183 is variable according to the length of the second member 182. However, the length of the third member 183 is determined so that the antenna apparatus can resonate by a path formed via the second member 182 and the third member 183.

The first member 181 and the third member 183 are disposed so as not to be electrically connected to each other. For prevention of coupling between the first member 181 and the third member 183, the first member 181 and the third member 183 are preferably spaced from each other by at least $0.2\lambda_1$ times of a wavelength ($\lambda_1$) corresponding to the first resonance frequency.

The first member 181 and the third member 183 may be spaced from each other by positioning the two members on different planes. For instance, the first member 181 is formed on a first plane, and the third member 183 is formed on a second plane spaced from the first plane. Under such configuration, the first member 181 and the third member 183 may be spaced from each other by the interval between the first plane and the second plane.

In order to obtain a prescribed length within a limited volume, the third to member 183 may be bent.

Figure 8:
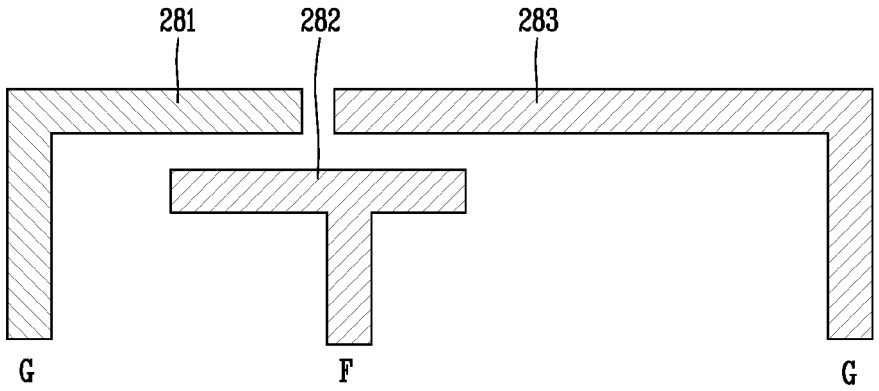
FIG. 8 is a conceptual view of an antenna apparatus according to a second embodiment of the present invention.

FIG. 8 is a conceptual view of an antenna apparatus 280 according to a second embodiment of the present invention.

The antenna apparatus 280 according to the second embodiment of the present invention includes a first member 281 ground-connected to a ground of a PCB, and a second member 282 spaced from the first member 281 in parallel. The antenna apparatus 280 further includes a third member 283 spaced from the second member 282 in parallel.

The first to third members 281~283 may be formed on the same plane, and at least two members may be spaced from each other on different planes.

The second member 282 capacitively coupling-feeds the first member 281 so that the antenna apparatus 280 can have a first resonance frequency. Preferably, the interval between the first member 281 and the second member 282 is within the range of $0.1\lambda_1$~$0.2\lambda_1$ of $\lambda_1$ corresponding to the first resonance frequency.

The second member 282 capacitively coupling-feeds the third member 283 so that the antenna apparatus 280 can have a second resonance frequency. Preferably, the interval between the second member 282 and the third member 283 is within the range of $0.1\lambda_1$~$0.2\lambda_1$ of $\lambda_2$ corresponding to the second resonance frequency.

Referring to FIG. 8, the first member 281 and the third member 283 are bent from parts extending from the ground connection portion (G), in parallel to the second member 282, so as to be coupling-fed by the second member disposed therebetween.

A path implemented from the feed connection portion (F) via the second member 282 and the first member 281 coupling-fed to the second member 282, has a physical length corresponding to $\lambda_1/8$ of a wavelength ($\lambda_1$) corresponding to a first resonance frequency, so that the antenna apparatus may resonate in the first resonance frequency. And, a path implemented from the ground connection portion (G) via the second member 282 and the third member 283 coupling-fed to is the second member 282, has a physical length corresponding to $\lambda_2/8$ of the wavelength ($\lambda_2$) corresponding to a second resonance frequency, so that the antenna apparatus may resonate in the second resonance frequency.

The first member 281 and the third member 283 are formed so as not to be electrically connected to each other. As an example, in a case where the first member 281 is formed at one side of the second member 282, the third member 283 is disposed to face the first member 281 on another side of the second member 282.

Preferably, the length of the second member 282 is formed to be longer than ½ of the length of the first member 281, so that the antenna apparatus 280 can be much influenced by a capacitor implemented by the first member 281 and the second member 282 or the third member 283 and the second member 282 through coupling feed, than by an inductor implemented by the first member 281 or the third member 283. It is also preferable that the length of the second member 282 is longer than ½ of the length of the third member 283.

The antenna apparatus according to the second embodiment of the present invention resonates at a first resonance frequency as the first member is coupling-fed by the second member, and resonates at a second resonance frequency as the third member is coupling-fed by the second member.

The antenna apparatus 280 according to the second embodiment can to resonate at a lower frequency band, by using conductive members having a shorter length than those which do not adopt a capacitive coupling feeding method. That is, B13 or B17 communication service of long term evolution (LTE) corresponding to about 700 MHz, may be provided to the mobile terminal having a limited volume.

Figure 9:
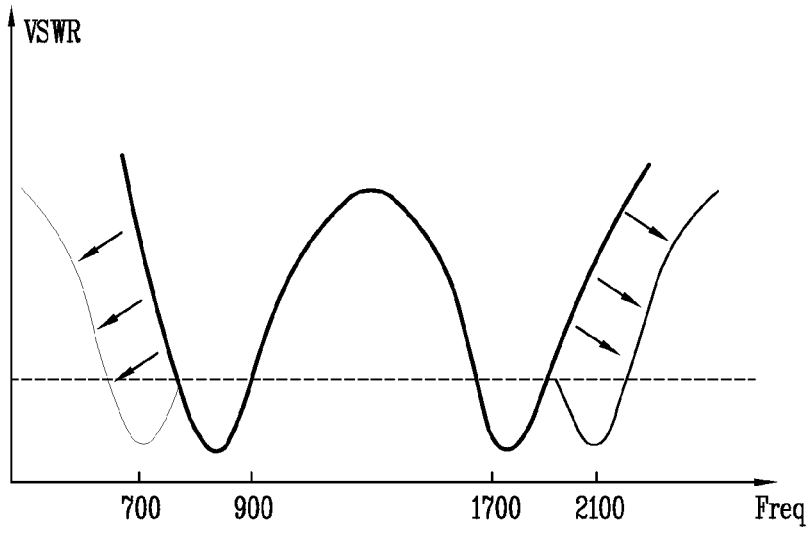
FIG. 9 is a graph showing voltage standing wave ratios (VSWR) according to frequencies of antenna apparatuses according to first and second embodiments.

FIG. 9 is a graph showing voltage standing wave ratios (VSWR) according to frequencies of the antenna apparatuses 180 and 280 according to the first and second embodiments.

As shown, the antenna apparatuses 180 and 280 according to the first and second embodiments have resonance frequencies corresponding to 700 MHz~960 MHz at a low frequency band. Therefore, can be provided not only a radio communication service in a cellular telephone band, but also a radio communication service in an LTE communication band.

Also, the antenna apparatuses 180 and 280 according to the first and second embodiments have resonance frequencies corresponding to maximum 2170 MHz, so that communication can be performed even at a band of 1.92~2.17 GHz for a wideband code division multiple access (WCDMA) service corresponding to a high frequency band.

Figure 10A:
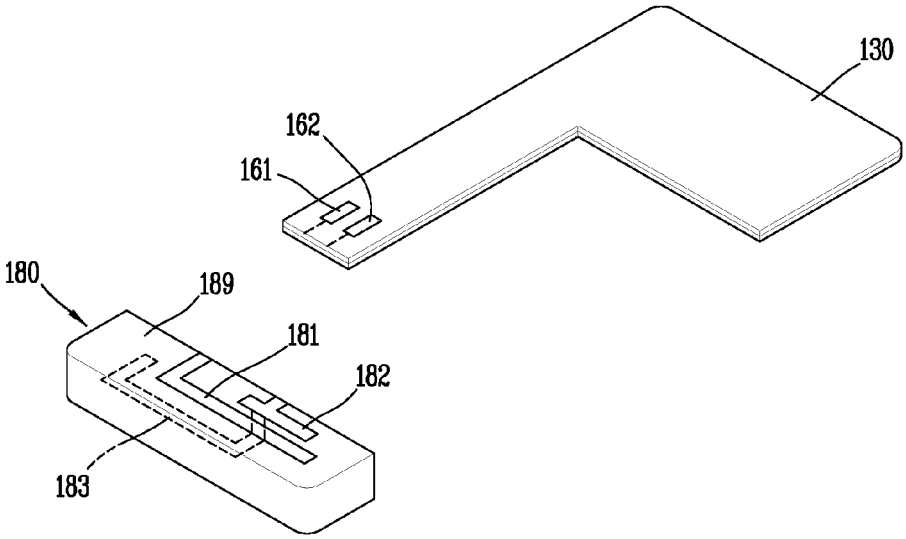
FIG. 10A is a conceptual view showing a coupled state between an antenna apparatus and a printed circuit board according to a first embodiment.
Figure 10B:
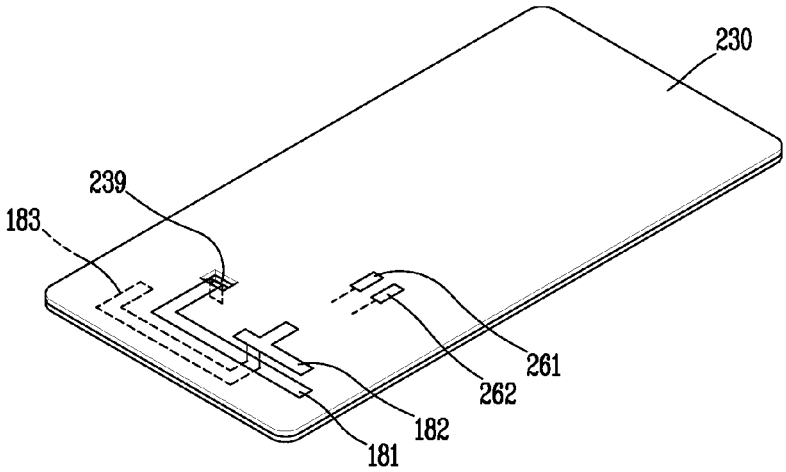
FIG. 10B is a conceptual view showing a modification example of the embodiment of FIG. 10A.

FIG. 10A is a conceptual view showing a coupled state between the antenna apparatus 180 and the printed circuit board (PCB) according to the first embodiment, FIG. 10B is a conceptual view showing a modification example of the embodiment of FIG. 10A, and FIG. 100 is a reference view showing an application example where the antenna apparatus of the first embodiment is mounted to the mobile terminal.

The printed circuit boards 130 and 230 are electrically connected to the antenna apparatuses 180 and 280, and are configured to process radio signals (or radio electromagnetic waves) transmitted and received by the antenna apparatus 180. A plurality of transceiver circuits may be mounted to the PCBs 130 and 230 for processing of radio signals.

Transceiver circuits 161, 162, 261 and 262 may include at least one integrated circuit and related electric device. For instance, the transceiver circuits 161, 162, 261 and 262 may include a transmission integrated circuit, a reception integrated circuit, a switching circuit, an amplifier, etc.

The transceiver circuits 161, 162, 261 and 262 may simultaneously operate by simultaneously feeding radiators (conductive members). For instance, one is configured to transmit radio signals, whereas another is configured to receive radio signals. Alternatively, both of the transceiver circuits may be configured to transmit or receive radio signals.

The antenna apparatus 180 may be partially formed on the case or the battery cover of the terminal body. Alternatively, the antenna apparatus 180 may be formed on a carrier in a thermal-bonding manner, or in a pressing manner. Here, the pressing manner indicates mounting a conductive metallic plate to serve as a radiator, to a carrier formed of plastic in a proper shape. Alternatively, the antenna apparatus 180 may be attached onto one surface of the PCB in a printing manner or in the form of a film.

FIG. 10A shows that the members of the antenna apparatus 180 are formed on the carrier 189, and FIG. 10B shows that the members of the antenna apparatus 180 are formed on the PCB 230.

Referring to FIG. 10A, the first member 181 and the second member 182 are formed on one surface of the carrier 189, and the third member 183 is formed at an inner space of the carrier 189. The first member 181 and the third member 183 are spaced from each other in different spaces so as not to be electrically connected to each other.

The first member 181 is ground-connected to the ground of the PCB 130 disposed close thereto, and the second member 182 is feed-connected to the PCB 130 disposed close thereto.

A path implemented from the feed connection portion (F) via the second member 182 and the first member 181, has a resonance length corresponding to $\lambda_1/8$ of a wavelength ($\lambda_1$) corresponding to the first frequency. And, a path implemented from the feed connection portion (F) via the second member 182 and the third member 183, has a resonance length corresponding to $\lambda_2/4$ of a wavelength ($\lambda_2$) corresponding to the second frequency.

The first frequency band is a frequency band corresponding to GSM-850 or GSM-900 communication service, and the second frequency band is a frequency band corresponding to B13 or B17 communication service of long term evolution (LTE). As an example, the first frequency band is a frequency band including a resonance frequency of about 900 MHz, and the second frequency band is a frequency band including a resonance frequency of about 700 MHz.

Referring to FIG. 10B, the first member 181 and the second member 182 may be formed on a first layer of the PCB, and the third member 183 may be formed on a second layer of the PCB. The first member 181 and the third member 183 are spaced from each other on different layers of the PCB, for prevention of electrical connection therebetween.

The PCB may be provided with a hole 239, through which the first member 181 is accessible to the ground formed on another surface of the PCB.

FIG. 100 shows the antenna apparatus formed below the mobile terminal. Members 181', 182' and 183' of the antenna apparatus are formed on a rear case 102' for accommodating the battery 125 therein.

More specifically, the members are formed on the upper surface or the side surface of the rear case 102'. The second member 182' is formed on the is upper surface of the rear case 102' in one-sided manner. For coupling feed with the second member 182', at least part of the first member 181' is formed in parallel with the second member 182', on the side surface of the rear case 102'. And, the first member 181' extends up to the upper surface of the rear case 102', so as to have a physical length corresponding to a resonance frequency. The third member 183' may be connected to the first member 181', or the feed connection portion. However, the third member 183' is extending from the inner side of the rear case 102', up to the side surface and the upper surface of the rear case 102', for prevention of electrical connection with the first member 181'.

Each member may be bent a plurality of times. One reason why each member is extending in a bending manner, is in order to obtain a physical length corresponding to a resonance frequency in a small space. Another reason why each member is extending in a bending manner, is in order to obtain a spacing distance from other components disposed close thereto.

The first member 181' may be extending from its one point, in parallel therewith. The parallel parts of the first member 181' may be coupled with each other, and a bandwidth of the antenna apparatus may increase due to increase of a capacitance.

Figure 10C:
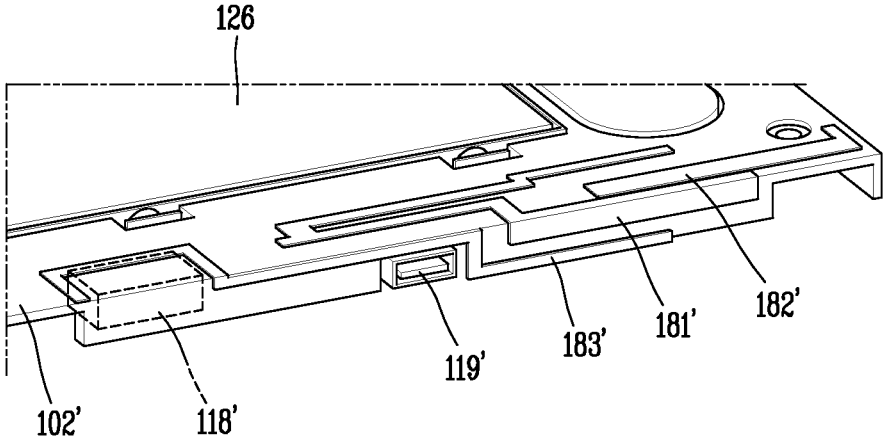
FIG. 10C is a reference view showing an application example where an antenna apparatus of a first embodiment is mounted to a mobile terminal.

Referring to FIG. 10C, a microphone 118' serving as a voice input unit may be formed on a central region of the lower surface of the rear case 102', so as to be spaced from the interface 119'. Each of the members of the antenna apparatus may have a radiation efficiency influenced by various types of electronic components such as the interface 119' and the microphone 118' mounted in the mobile terminal.

As shown in FIG. 100, the third member 183' may be bent so as to be is spaced from part of the rear case 102' where the interface 119' and the microphone 118' are formed.

Figure 11A:
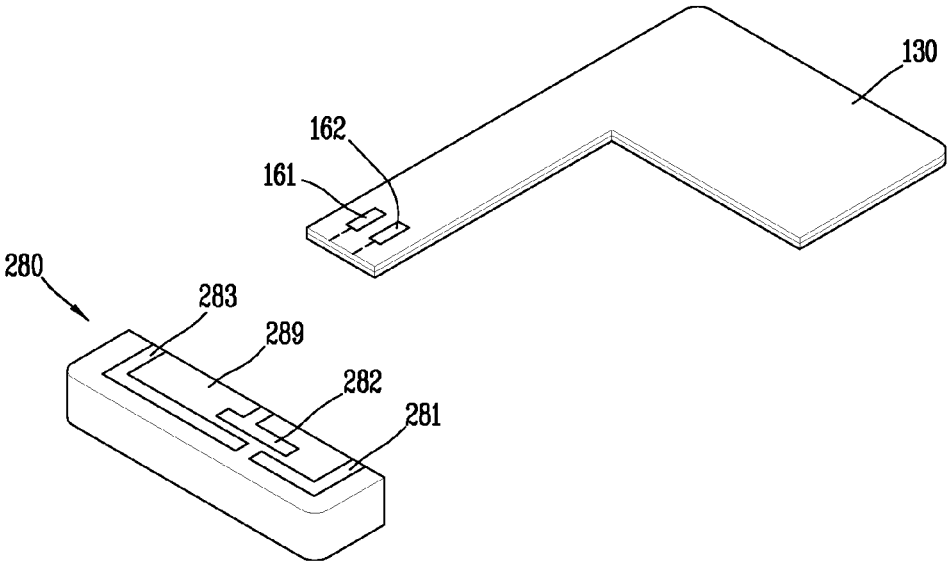
FIG. 11A is a conceptual view showing a coupled state between an is antenna apparatus and a printed circuit board according to a second embodiment.
Figure 11B:
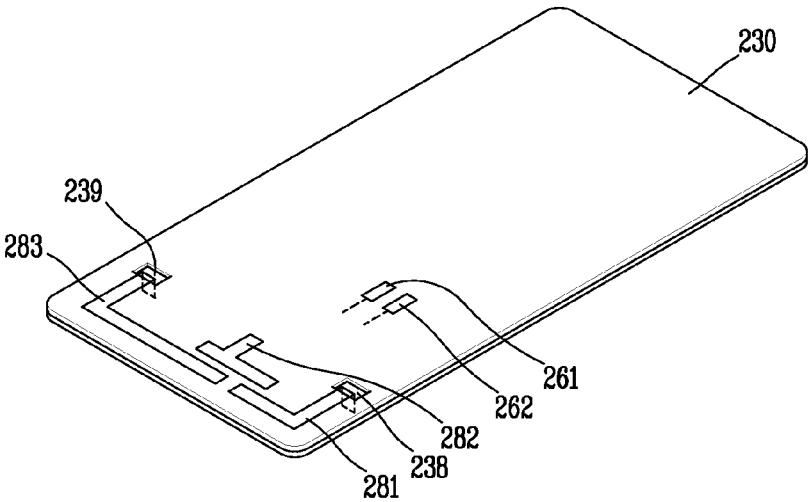
FIG. 11B is a conceptual view showing a modification example of the embodiment of FIG. 11A.
Figure 11C:
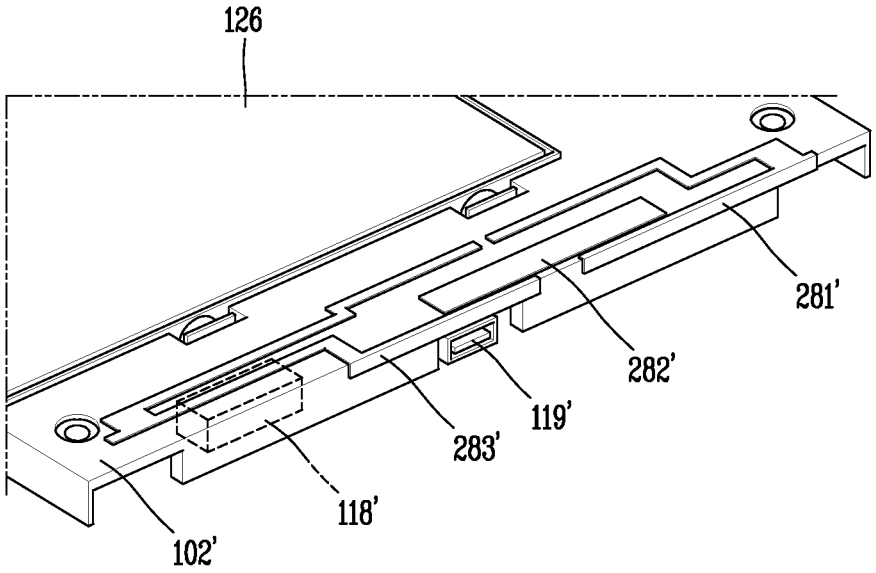
FIG. 11C is a reference view showing an application example where an antenna apparatus of a second embodiment is mounted to a mobile terminal.

FIG. 11A is a conceptual view showing a coupled state between the antenna apparatus 280 and the printed circuit board according to a second embodiment, FIG. 11B is a conceptual view showing a modification example of the embodiment of FIG. 11A, and FIG. 11C is a reference view showing an application example where the antenna apparatus of the second embodiment is mounted to a mobile terminal. The same or similar configurations as or to those of the aforementioned embodiment will not be explained.

Referring to FIG. 11A, a first member 281, a second member 282 and a third member 283 of the antenna apparatus 280 according to the second embodiment, are formed on one surface of a carrier 289. The first member 281 and the third member 283 are ground-connected to a ground of the PCB 130 disposed close thereto, and the second member 282 is feed-connected to the PCB 130 disposed close thereto.

The first member 281 and the third member 283 are disposed on different positions of the carrier, for prevention of electrical connection therebetween.

Referring to FIG. 11B, the first member 281, the second member 282 and the third member 283 of the antenna apparatus 280 according to the second embodiment, are formed on one surface of the PCB 230. The PCB 230 is provided with holes 238 and 239, through which the first member 281 and the third member 283 is accessible to a ground formed on another surface of the PCB 230.

The first member 281 and the third member 283 are disposed on different positions of the PCB 230, for prevention of electrical connection therebetween.

FIG. 11C shows the antenna apparatus formed below the mobile terminal. Members 281', 282' and 283' of the antenna apparatus may be formed on the rear case 102' for accommodating the battery 125 therein.

More specifically, the members are formed on the upper surface or the side surface of the rear case 102'. The second member 282' is formed on a central region of the upper surface of the rear case 102', so as to gap coupling-feed the first member 281' and the third member 283'.

The first member 281' and the third member 283' are extending from the side surface of the rear case 102' in parallel with each other, for coupling feed with the second member 282'. Then, the first member 281' and the third member 283' are bent so as to have a physical length corresponding to a resonance frequency to thus be extending up to the upper surface of the rear case 102'.

However, the first member 281' and the third member 283' are disposed at two sides based on the second member 282', for prevention of electrical connection therebetween.

Each member 281', 282' and 283' may be extending in a bending manner a plurality of times. One reason why each member is extending in a bending manner, is in order to obtain a physical length corresponding to a resonance frequency in a small space. Another reason why each member is extending in a bending manner, is in order to obtain a spacing distance from other components disposed close thereto.

The third member 283' may be extending from its one point, in parallel therewith. The parallel parts of the third member 283' may be coupled with each other, and a bandwidth of the antenna apparatus may increase due to increase of a capacitance.

Referring to FIG. 11C, a microphone 118' serving as a voice input unit may is be formed on a central region of the lower surface of the rear case 102', so as to be spaced from the interface 119'. Each of the members 281', 282' and 283' of the antenna apparatus may have a radiation efficiency influenced by various types of electronic components such as the interface 119' and the microphone 118' mounted in the mobile terminal.

As shown in FIG. 11C, the third member 283' may be bent so as to be spaced from part of the rear case 102' where the interface 119' and the microphone 118' are formed.

Referring to FIGS. 10B and 11B back, the ground connection portion (G) is formed at one end of the first member 181 (or 281). The ground connection portion (G) is configured to connect the first member 181 (or 281) to a ground of the PCB 230, and to electrically-short the first member 181 (or 281) for impedance matching with respect to a resonance frequency of the antenna apparatus. The ground connection portion (G) may be provided with at least two paths having different lengths, and may be provided with switches corresponding to the paths. Through the switches, the respective paths connect the ground with the conductive members in different lengths. The path indicates an electric passage for connecting a ground with a radiator, which may include at least one of a grounding plate, a grounding clip and a grounding line. Further, the paths may have different lengths as grounding lines are formed in different lengths.

In the second embodiment, the ground connection portion (G) is also formed at one end of the first member 283 ground-connected to the ground of the PCB.

The feed connection portion (F) is formed at one end of the second member 282 feed-connected to the PCB. The feed connection portion (F) is configured to electrically connect a feeding device (not shown) with the second member 282, or to feed the second member 282 in an electro-magnetic feeding manner. For such connection, the feed connection portion (F) may include at least one of a feeding plate, a feeding clip and a feeding line. One of the feeding plate, the feeding clip and the feeding line may be electrically connected to another, thereby transmitting a current (or voltage) fed by the feeding device to the members which transmit and receive radio signals. Here, the feeding line may include a micro-strip printed onto the PCB.

Each of the first members 181, 282, the second members 182, 282, and the third members 183, 283 is formed as a partial or whole conductor. All of the first to third members operate as part of radiators of the mobile terminal.

Figure 12:
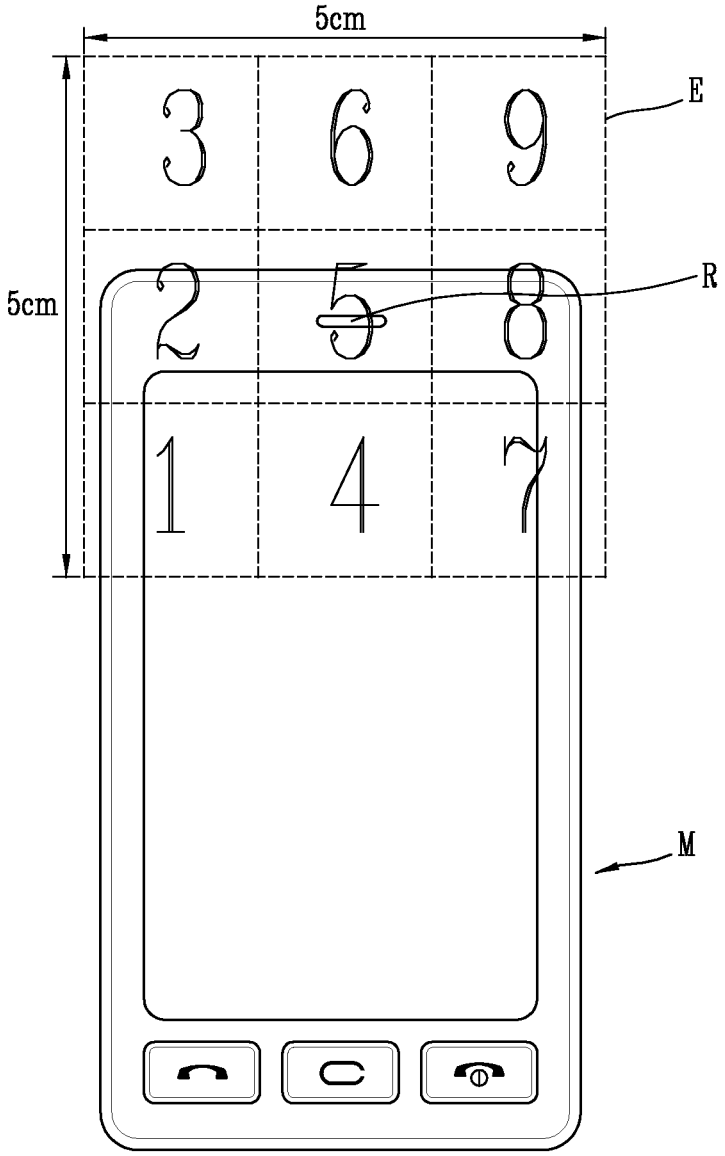
FIG. 12 is a view showing a method for measuring the intensity of an electrical field around a mobile terminal defined by hearing aid compatibility (HAC)
Figure 13:
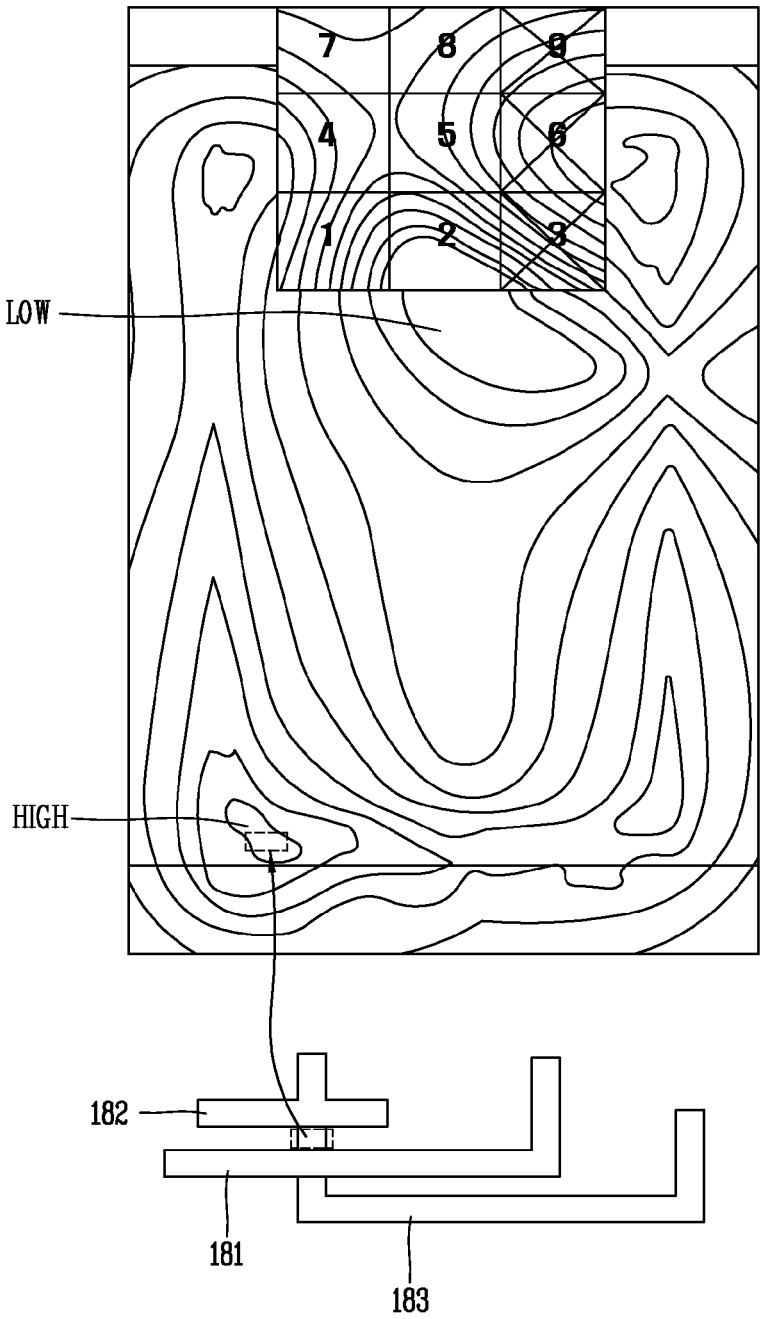
FIG. 13 is a conceptual view showing distribution of an electrical field intensity of an antenna apparatus according to a first embodiment of the present invention.
Figure 14:
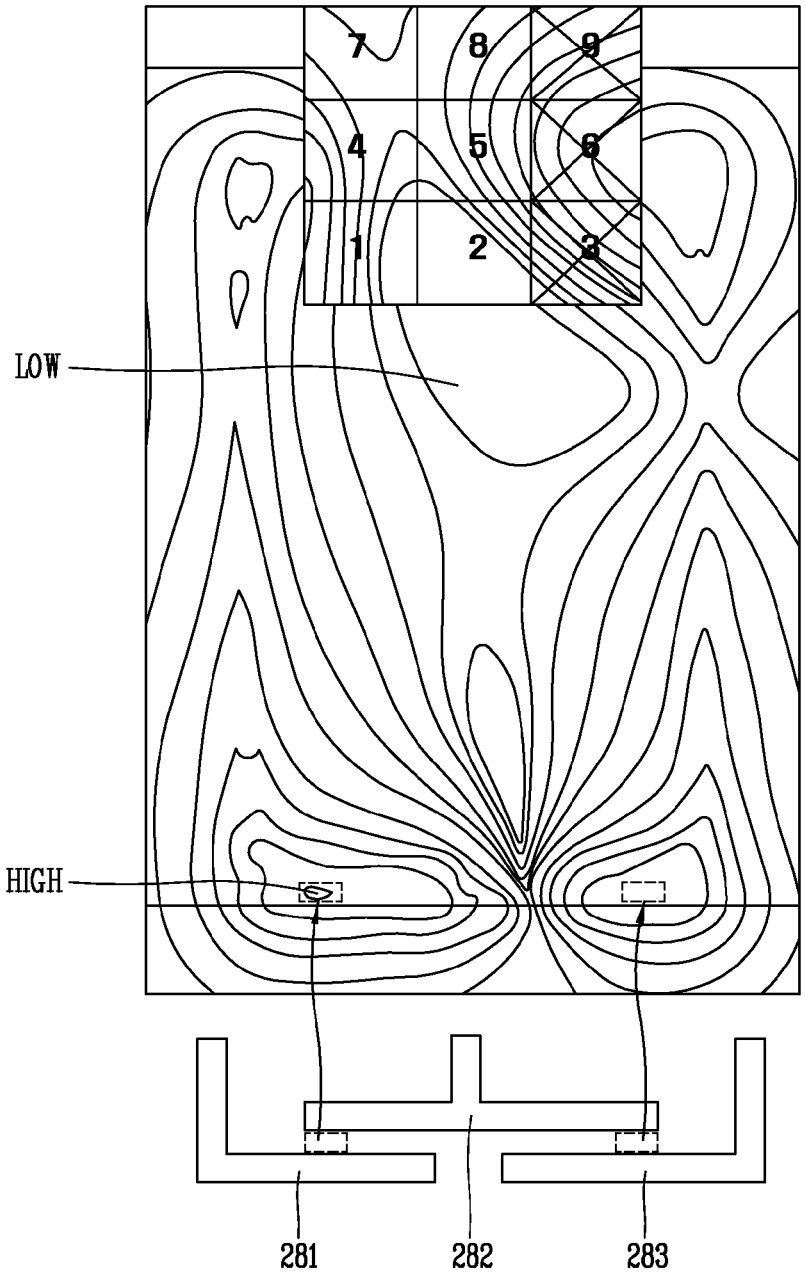
FIG. 14 is a conceptual view showing distribution of an electrical field intensity of an antenna apparatus according to a second embodiment of the present invention.

FIG. 12 is a view showing a method for measuring the intensity of an electrical field around a mobile terminal defined by hearing aid compatibility (HAC), FIG. 13 is a conceptual view showing distribution of an electrical field intensity of an antenna apparatus according to a first embodiment of the present invention, and FIG. 14 is a conceptual view showing distribution of an electrical field intensity of an antenna apparatus according to a second embodiment of the present invention.

Recently, increased are concerns about influences of an electromagnetic wave generated from a mobile terminal, on the human body. Further, increased are concerns about interference between a hearing aid and a mobile terminal of a user wearing the hearing aid, and a malfunction of the hearing aid due to an electromagnetic wave generated from the mobile terminal.

The US Hearing Aid Compatibility (HAC) Act serves to test and ensure compatibility between a wearer's hearing aid and a portable terminal without is interference with each other. The HAC act was legislated by the Federal Communications Commission (FCC). The HAC Act is being applied to manufacturers for wireless devices such as hearing aids and portable terminals. In the United States, manufacturers for wireless devices are required to ensure manufactured products for sales meet certain ratings. Application on such HAC Act is being spread worldwide.

A magnetic field generated from a mobile terminal is sensed by a tele-coil (T-coil) of a hearing aid, and is amplified so that a call sound can be transmitted to a user. The HAC Act provides a method for measuring a magnetic response of a hearing aid and a specified value.

A method for measuring a HAC rating of a mobile terminal will be explained with reference to FIG. 1.

A mobile terminal (M) is fixed onto a supporting member. And, a strength of an electromagnetic wave in a call mode (a receiver (R) is activated) is measured by a probe used to measure an E-field or an H-field, or the like.

A measuring region (E) is a square-shaped region (5 cm*5 cm) formed based on the center of the receiver (R), and corresponds to a region on a virtual plane in a space far from the surface of the portable terminal (M) by 1 cm. The measuring region (E) is divided into 9 sub-regions (1~9) in the form of grids.

In order to measure a HAC rating, electromagnetic waves of the sub-regions (1~9) excluding the central sub-region (5) and three sub-regions having relatively high field strengths of electromagnetic waves are measured. That is, a highest field strength of electromagnetic waves measured with respect to the rest five sub-regions serves as a peak value to determine a HAC rating. As a result, a rating labeled within a range including the peak value is determined as a HAC rating of the mobile terminal (M).

The HAC ratings are categorized into 'M' ratings (M1 to M4, M4' is the best) with respect to radio frequency (RF) interference, and 'T' ratings (T1 to T4: 'T4' is the best) with respect to inductive coupling. Since the 'M' ratings are more dominant than the 'T' ratings, there is required a method for enhancing the 'M' ratings.

The antenna apparatus 180 according to the present invention is formed close to the lower end of the mobile terminal. A receiver is formed at the upper end of the mobile terminal. Conductive members serving as radiators of the antenna apparatus 180 are formed so as to be gap-coupling fed, such that the antenna apparatus is more influenced by a capacitor than by an inductor.

FIG. 13 shows that conductive members according to a first embodiment are formed on a carrier. That is, a first member 181 ground-connected to a ground of a PCB is capacitively coupling-fed by a second member 182.

Referring to FIG. 13, the central sub-region and the three sub-regions having relatively high field strengths of electromagnetic waves have field strengths of 5, 3, 6 and 9, respectively. A highest field strength of electromagnetic waves measured with respect to the rest five sub-regions serves as a peak value. Here, the peak value is 37.5 dBV/m, which is close to 'M4'.

FIG. 14 shows that conductive members according to a second embodiment are formed on a carrier. That is, a first member 281 ground-connected to a ground of a PCB and a third member 283 are capacitive coupling-fed by a second member 282.

Referring to FIG. 14, the central sub-region and the three sub-regions having relatively high field strengths of electromagnetic waves have field strengths is of 5, 3, 6 and 9, respectively. A highest field strength of electromagnetic waves measured with respect to the rest five sub-regions serves as a peak value. Here, the peak value is 34.1 dBV/m, which is close to 'M4'.

If the member spaced from the second member 182 (or 282) is fed by gap coupling feed, the amount of a current applied onto the PCB is reduced, thereby decreasing the intensity of an electric field formed around the receiver. This may reduce interference of an electric field formed around the mobile terminal, on the hearing aid.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. An antenna apparatus, comprising:

a first member ground-connected to a printed circuit board (PCB);

a second member spaced from the first member, and configured to capacitively coupling-feed the first member so as to transmit and receive signals of a first frequency band; and a third member extending from the second member by a prescribed length, so as to have a second frequency band different from the first frequency band, wherein the first member and the second member are formed on a first plane, and at least a portion of the third member is formed on a second plane spaced from the first plane, and wherein the third member extends along a surface between the first plane and the second plane.

2. The antenna apparatus of claim 1, wherein the first member and the third member are spaced from each other by a distance more than $0.2\lambda_1$ times of a wavelength ($\lambda_1$) corresponding to a first resonance frequency, for prevention of electrical connection therebetween.

3. The antenna apparatus of claim 1, wherein the first member is connected to a ground of the PCB adjacent thereto, and the second member is feed-connected to the PCB.

4. The antenna apparatus of claim 1, wherein the first frequency band is a frequency band corresponding to GSM-850 or GSM-900 communication service, and wherein the second frequency band is a frequency band corresponding to B13 or B17 communication service of long term evolution (LTE).

5. The antenna apparatus of claim 4, wherein a path implemented from a feed connection portion (F) of the PCB via the second member and the first member, forms a resonance length corresponding to $\lambda_1/8$ of a wavelength ($\lambda_1$) corresponding to the first resonance frequency.

6. The antenna apparatus of claim 4, wherein a path implemented from the feed connection portion (F) of the PCB via the second member and the third member, forms a resonance length corresponding to $\lambda_2/4$ of a wavelength ($\lambda_2$) corresponding to a second resonance frequency.

7. The antenna apparatus of claim 1, wherein the length of the second member extending from the first member is more than ½ of the length of the first member.

8. An antenna apparatus, comprising:

a first member ground-connected to a printed circuit board (PCB);

a second member having at least a part thereof configured to capacitively coupling-feed the first member so as to transmit and receive signals of a first frequency band; and a third member ground-connected to the PCB, having at least part thereof facing the second member, so as to have a second frequency band different from the first frequency band, and configured to be capacitively coupling-fed by the second member, wherein the first member is disposed to face one side of the second member, and the third member is disposed to face another side of the second member.

9. The antenna apparatus of claim 8, wherein the interval between the first member and the second member is within the range of $0.1\lambda_1$~$0.2\lambda_1$ of a wavelength ($\lambda_1$) corresponding to a first resonance frequency, and wherein the interval between the second member and the third member is within the range of $0.1\lambda_1$~$0.2\lambda_1$ of a wavelength ($\lambda_2$) corresponding to a second resonance frequency.

10. The antenna apparatus of claim 8, wherein the first, second and third members are formed on a carrier different from the PCB, and wherein the first and third members are disposed on different positions of the carrier for prevention of electrical connection therebetween.

11. A mobile terminal, comprising:

a terminal body;

a printed circuit board (PCB) mounted in the terminal body; and an antenna apparatus mounted below the terminal body, and configured to transmit and receive signals of a first frequency band or a second frequency band different from the first frequency band, by being feed-connected and ground-connected to the PCB, wherein the antenna apparatus comprises:

a first member ground-connected to the PCB;

a second member spaced from the first member, and configured to capacitively coupling-feed the first member so as to transmit and receive signals of the first frequency band; and a third member extending from the second member by a prescribed length, so as to have the second frequency band, wherein the first member and the second member are formed on a first plane, and at least a portion of the third member is formed on a second plane spaced from the first plane, and wherein the third member extends along a surface between the first plane and the second plane.

12. The mobile terminal of claim 11, wherein the first and second members are formed on a first layer of the PCB, and wherein the third member is formed on a second layer spaced from the first layer for prevention of electrical connection with the first member.

13. The mobile terminal of claim 11, wherein the first, second and third members are formed on a carrier different from the PCB, and wherein the first and third members are disposed on different positions of the carrier for prevention of electrical connection therebetween.

14. The mobile terminal of claim 11, wherein the first member is connected to a ground of the PCB adjacent thereto, and the second member is feed-connected to the PCB.

15. The mobile terminal of claim 11, wherein the first frequency band is a frequency band corresponding to GSM-850 or GSM-900 communication service, and wherein the second frequency band is a frequency band corresponding to B13 or B17 communication service of long term evolution (LTE).

16. The mobile terminal of claim 15, wherein a path implemented from a feed connection portion (F) of the PCB via the second member and the first member, forms a resonance length corresponding to $\lambda_1/8$ of a wavelength ($\lambda_1$) corresponding to the first frequency.

17. The mobile terminal of claim 15, wherein a path implemented from the feed connection portion (F) of the PCB via the second member and the third member, forms a resonance length corresponding to $\lambda_2/4$ of a wavelength ($\lambda_2$) corresponding to the second frequency.

18. A mobile terminal, comprising:

a terminal body;

a printed circuit board (PCB) mounted in the terminal body; and an antenna apparatus mounted below the terminal body, and configured to transmit and receive signals of a first frequency band or a second frequency band different from the first frequency band, by being feed-connected and ground-connected to the PCB, wherein the antenna apparatus comprises:

a first member ground-connected to the PCB;

a second member having at least a part thereof configured to capacitively coupling-feed the first member so as to transmit and receive signals of the first frequency band; and a third member ground-connected to the PCB, having at least part thereof facing the second member, so as to have the second frequency band different from the first frequency band, and configured to be capacitively coupling-fed by the second member, wherein the first member is disposed to face one side of the second member, and the third member is disposed to face another side of the second member.

19. The mobile terminal of claim 18, wherein the first and third members are connected to a ground of the PCB adjacent thereto, and wherein the second member is feed-connected to the PCB.

20. The mobile terminal of claim 18, wherein the first, second and third members are formed on a carrier different from the PCB, and wherein the first and third members are disposed on different positions of the carrier for prevention of electrical connection therebetween.

* * * * *